US005857302A

United States Patent [19]

Lill

[11] Patent Number: 5,857,302

[45] Date of Patent: Jan. 12, 1999

[54] CONCRETE CRACK CONTROL SYSTEM

[76] Inventor: Deryl L. Lill, 4910 Skyway Dr., Cedar Hill, Mo. 63016

[21] Appl. No.: 831,879

[22] Filed: Apr. 2, 1997

[51] Int. Cl.[6] ..... E04G 23/02; E02D 27/42

[52] U.S. Cl. ..... 52/514.5; 52/297; 52/295; 404/47; 404/70

[58] Field of Search ..... 52/260, 514, 514.5, 52/741.3, 742.14, 294, 295, 296, 297; 44/47, 70

[56] References Cited

U.S. PATENT DOCUMENTS

| | | | |
|---|---|---|---|
| 4,168,924 | 9/1979 | Draper et al. . | |
| 5,224,313 | 7/1993 | Guillebeau, III | 52/295 X |
| 5,476,340 | 12/1995 | Contrasto | 404/70 X |
| 5,503,082 | 4/1996 | Bosma . | |
| 5,623,798 | 4/1997 | Crews et al. | 52/514 X |
| 5,685,115 | 11/1997 | Colfer | 52/742.14 X |

*Primary Examiner*—Christopher Kent
*Assistant Examiner*—Yvonne Horton-Richardson
*Attorney, Agent, or Firm*—Robbins & Robbins

[57] ABSTRACT

A concrete crack control system is provided. The system comprises a vane or angle projecting from a wall, such as a pedestal or column or other wall surfaces against which a concrete floor or slab is poured. After the concrete has set to firm consistency, a saw cut is provided of a substantial depth in line with the projecting vane. The exposed saw cut may be filled with conventional filler, such as grout or the like. Any tendency of the floor to crack upon aging will be along the line of the vane and saw cut, thereby preventing crack damage to the floor.

14 Claims, 5 Drawing Sheets

CONCRETE CRACK CONTROL SYSTEM

BACKGROUND OF THE INVENTION

Generally, concrete shrinks as it sets. The shrinkage is small and like concrete strength it is about 80% complete in 30 days.

This is generally understood in the construction industry and several methods have been employed to deal with it. The most common method is to saw cut the concrete slab as soon as it can support a worker. The long accepted method, is to saw to ¼ of the slab thickness at intervals of about ten to twelve feet. This does not stop the cracking but keeps the cracks in straight lines. If floor coverings are required, the saw joints can be filled at a later date. This is generally successful with pavements but less successful inside buildings.

The most common problem in buildings is the columns supporting upper floors and/or roof. Cracks frequently form off of the corners of rectangular columns. Designers want the joint pattern on column lines, parallel to the walls and the sides of the columns parallel to the walls.

Experience has shown that unless concrete slabs are sawn to any included inside corners, such as column pedestals, stairways, pits etc., cracks will generally start at the corners and proceed randomly across the slab. Even sawing very near these locations, is still frequently unsuccessful at controlling these cracks.

Industry practice is to form diamonds around rectangular columns. This practice rotates the column corners 90 degrees to put them in alignment with column center lines while isolating the floor from the foundation. Joints are then sawn on column lines. This practice requires separate forming and concrete pouring operations for the diamonds. The final result usually controls cracking, but leaves an extra joint around each column and some minor elevation differences between diamonds and floor. These areas require an additional leveling operation before installing floor coverings and then slight movement in these joints results in cracks or bumps in the floor coverings.

Another practice, frequently utilized around large floor openings, is to add a couple of short pieces of reinforcing steel diagonally across the corners. This practice is less effective in eliminating corner cracks. However, it does tend to minimize excessive movement in the crack.

There has continued to be a problem for satisfactory crack control in concrete slabs or floors and particularly around columns.

SUMMARY OF THE INVENTION

By means of this invention there has been provided a crack control system used for freshly laid concrete slabs, floors and the like.

The system comprises providing a vane or angle on upstanding structures such as pedestals, piers, columns, pipes, forms, stairs or the like, against which the concrete is to be poured and abutted. The vane is affixed to the pedestal before the concrete is poured in such a manner that it extends perpendicularly to the pedestal just under the surface level of the slab to be established. The vane is directed in line with a saw cut to be made in the concrete after it has set.

After the concrete has been poured and is firm enough to support a workman, a saw cut is made, such as perpendicularly to the pedestal in line with the vane. The cut is made into the vane as far as a circular saw can extend. After the saw cut has been made, it may be filled with a compressible filler, such as grout or the like.

The vane may be made of aluminum or plastic, such that it may be cut without damage to the concrete saw employed. In its simplest form, the vane is an L-shaped angle with one leg attached to the pedestal by concrete screws or the like. The vane may be downwardly tapered for easy removal from exposed walls where patching is required. It may also be fabricated with a vertical keyway which may be fitted to a key, such as vertically aligned concrete screws, on the pedestal. Flexible plastic blanks which may be stacked and fabricated to the shape of the desired vane when the time comes for use, may be employed.

The system provided by the invention may be simply and easily employed in the field at low cost and great efficiency.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

There are shown in the accompanying drawings various embodiments of the invention.

IN THE DRAWINGS

DESCRIPTION OF THE INVENTION

In theory, it appeared that inside corners actually behave like stress risers. Stresses concentrate and reach a maximum at the point of the corner. Compounding that problem is the fact that a round saw blade on a saw with any kind of guard cannot saw all the way to the edge of the structure or obstruction. This means that the entire saw cut is actually surrounded by a full thickness of the concrete slab. The stresses in the slab, below the saw cut, are uniformly distributed along the length of the slab. Therefore, the maximum tensile strength of the concrete is often reached at the corners long before it accumulates at the saw joint. Once the concrete fails and the crack starts, the stress is relieved at any nearby saw joint. The crack now proceeds, across the slab with little or no regard to the saw joint. Only when the saw joint is intersected by the cracks meandering path will the crack return to the saw joint.

Based upon this theory, the present invention achieves the same result of diamonds used around obstructions such as pedestals, piers, columns or the like by using four pieces of angle or vane. The angle is completely imbedded in the concrete pour. The angle has one leg fastened to the surface of the column or obstruction, such that the other leg protrudes into the slab. This outstanding leg is positioned on the column center lines. The vertical length or height of the angle should be substantially the same as the slab thickness to somewhat less in order that the top edge may be below the surface of the slab and not exposed in order that it may be covered by the slab but in any case, should be sufficient to establish a zone of weakness to direct any crack to be formed by stresses in the curing concrete. The intent is to produce a stress riser equal to or better than the column corners. A smooth material that can be readily sawed, such as aluminum or relatively stiff plastic, with low concrete adhesion is preferable. The saw joint should be cut all the way into the corner of the angle and extend into the vane about one-quarter the vane height. This method produces a weakness in the slab which is continuous from the edge to edge.

Figure 1:
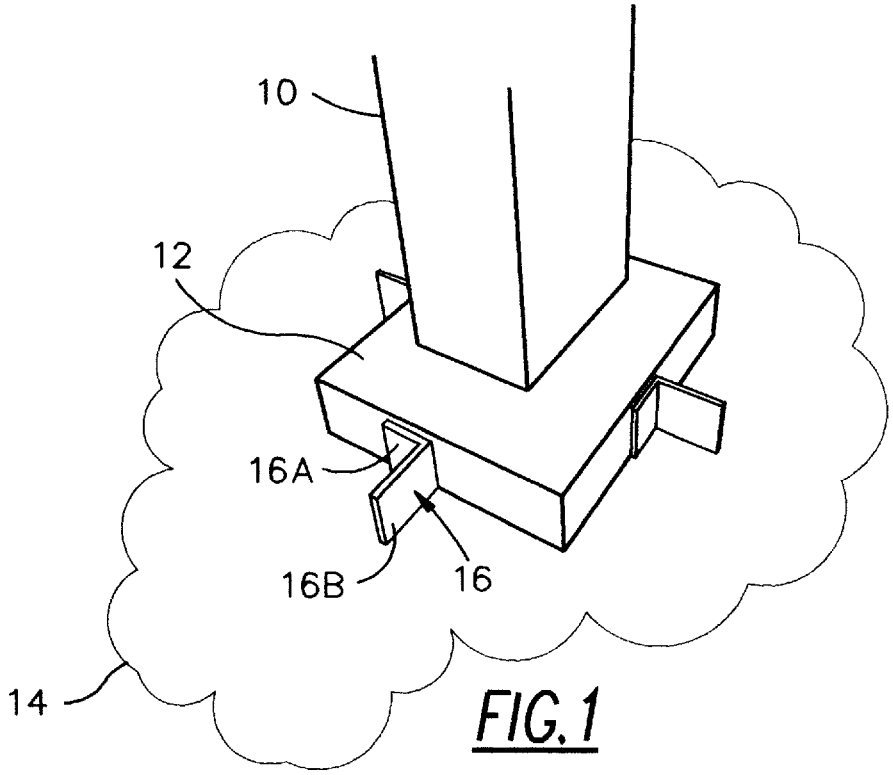
FIG. 1 is a pictorial view of a column and pedestal with attached vane.

In FIG. 1, there is shown a column 10 provided with a pier or pedestal 12 for construction inside a building (not shown). The pier is supported upon a ground surface 14 or foundation below. The concrete floor is to be poured upon a ground surface 14 to the top of the pier.

For the purpose of controlling crack formation an L-shaped angle or vane 16 is employed which for purpose of example may be +e,fra 3"×4"×1/4+ee " thick. The shorter 3" side 16A is attached to the concrete pedestal by concrete screws or the like (not shown), as will be readily understood in the art. The longer side 16B, is a crack directing member and extends perpendicularly to the column pedestal. The top of the angle may be affixed ⅛" to ¼" below the level of the concrete to be poured and location marked on the column for reference during sawing the poured concrete.

Upon setting of the concrete slab to a consistency to support the weight of worker, the slab is cut, as an example to a depth of 1 ⅛" with a commercial circular saw on the same day as the pour. The cut is made in line with the angle and through it to the pedestal leaving only a small uncut circular portion next to the pedestal due to the configuration of the circular saw.

Figure 2:
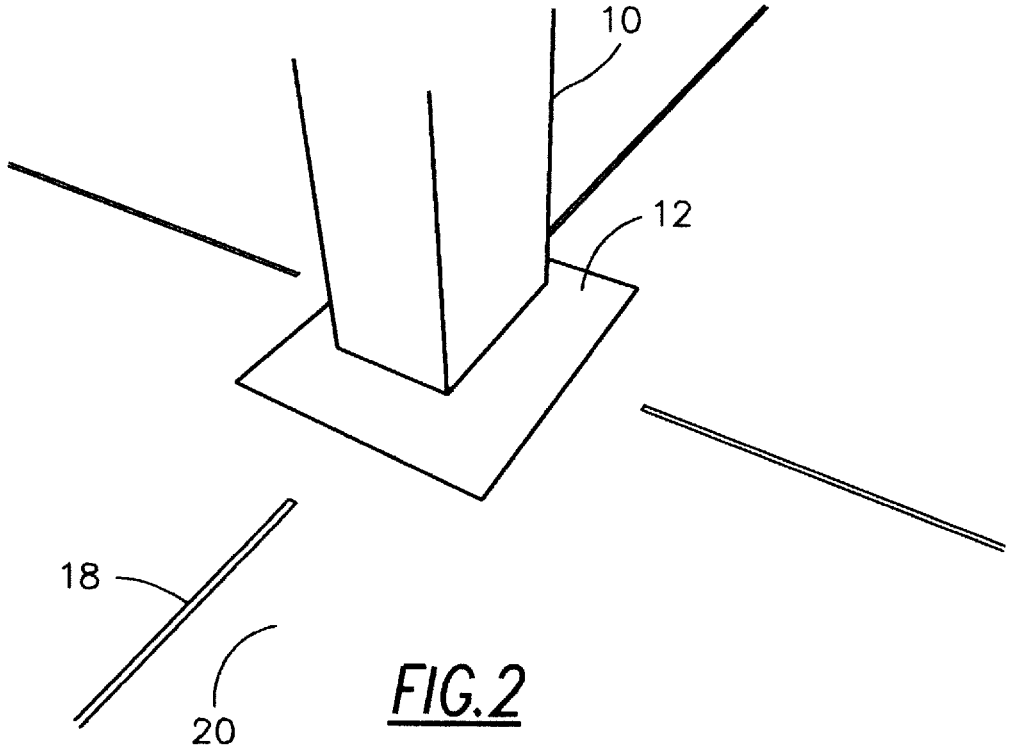
FIG. 2 is a view similar to FIG. 1 after concrete has been poured and a saw cut has been made.

FIG. 2 shows the saw cut as reference numeral 18 upon the poured slab 20. The use of the embedded vanes or angles provides a successful crack control in lieu of the conventional use of "diamond isolation joints".

Figure 3:
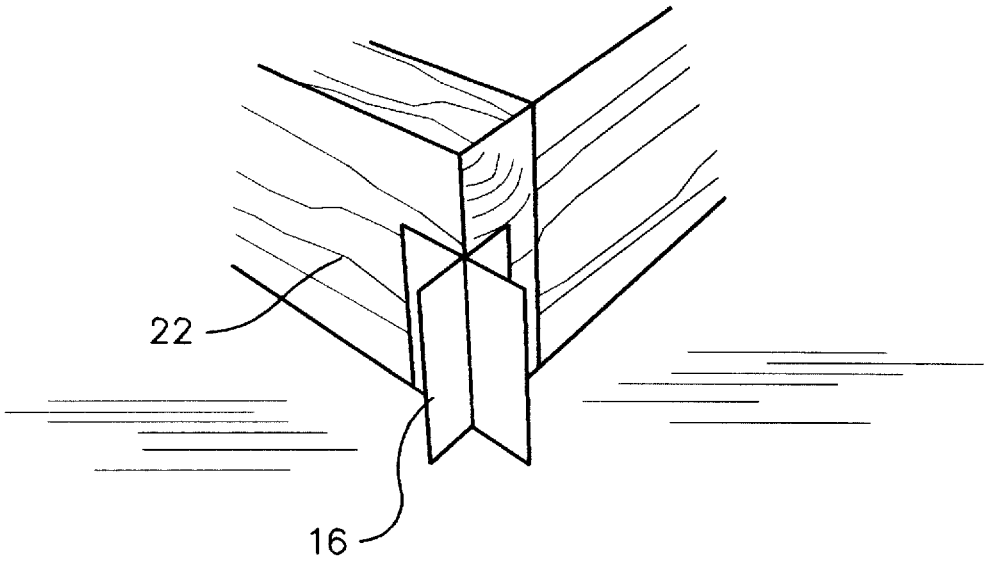
FIG. 3 is a partial pictorial view of a wood formed inside corner with vanes attached to the form.
Figure 4:
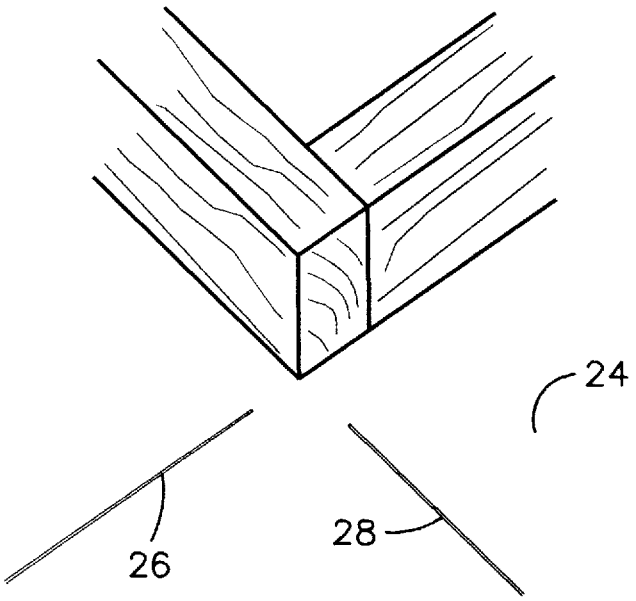
FIG. 4 is a view similar to FIG. 3 after concrete pouring and a saw cut with wood forms still in place.

FIG. 3 shows the use of two vanes installed on forms 22 at a corner of a pit. The vanes are constructed of a plastic material, such as polyethylene. FIG. 4 shows the form of FIG. 3. After pouring a slab 24, saw cuts 26 and 28 are made in line with the vanes 16. Cracks that may form will be along the saw cut lines 26 and 28. The wood forms would then be removed.

Figure 5:
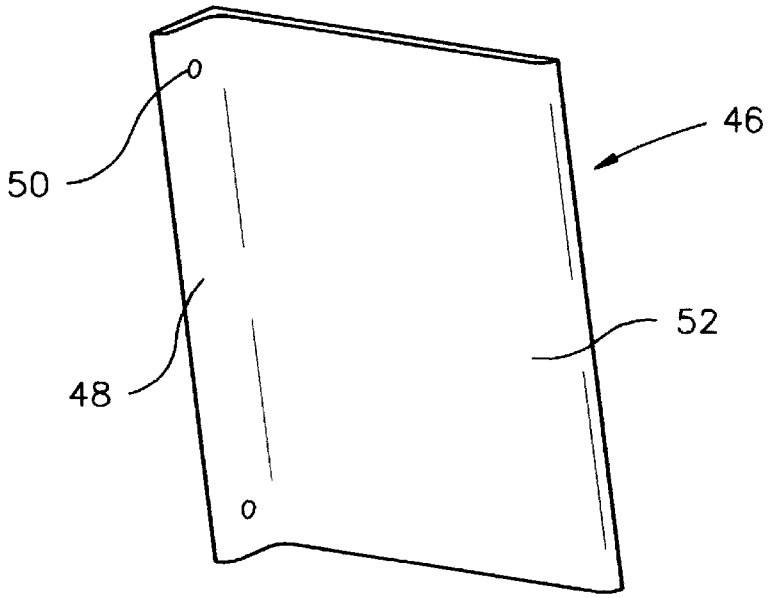
FIG. 5 is a pictorial view of an L-shaped vane.

A modified vane 46 is shown in FIG. 5. The vane is constructed of semi-flexible plastic and is provided with a short leg 48 provided with holes 50 for reception of concrete screws, nails or the like for affixation to a pedestal or other object that might concentrate stress in a concrete slab. An elongated leg 52 extends perpendicularly as the crack control member.

Figure 6A:
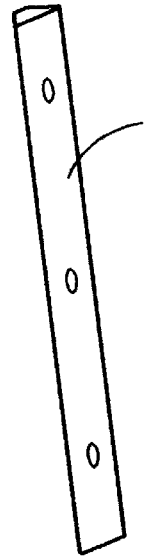
FIG. 6A is a pictorial view of a modified keyway.
Figure 6:
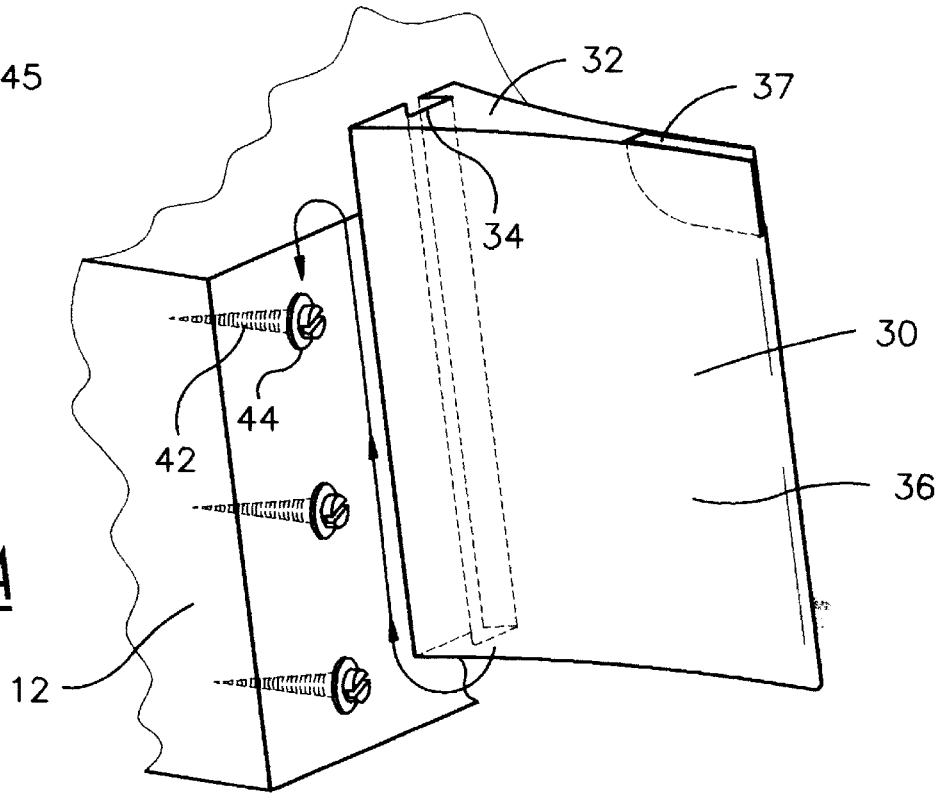
FIG. 6 is a pictorial view of a vane with a keyway prior to being fitted over a pedestal provided with attachment keys.

A modified vane 30 is shown in FIG. 6. It is comprised of a somewhat T-shaped body of plastic, aluminum or the like and has a thickened head 32 provided with a keyway 34 having a trapezoidal cross-section. An elongated leg 36 extends perpendicularly as a crack directing member. The saw-cut into the leg 36 is shown by reference numeral 37 and depth about one-quarter the height of the leg.

In order to affix the vane 30 to a pedestal 12, keys such as in the form of uncut screws 42 having a head 44, are provided.

The vane is installed by fitting the screw heads in the keyway 34. FIG. 6A shows a modified key in the form of a strip 45 having a trapezoidal cross-section which interfits with the key way 34.

Figure 7:
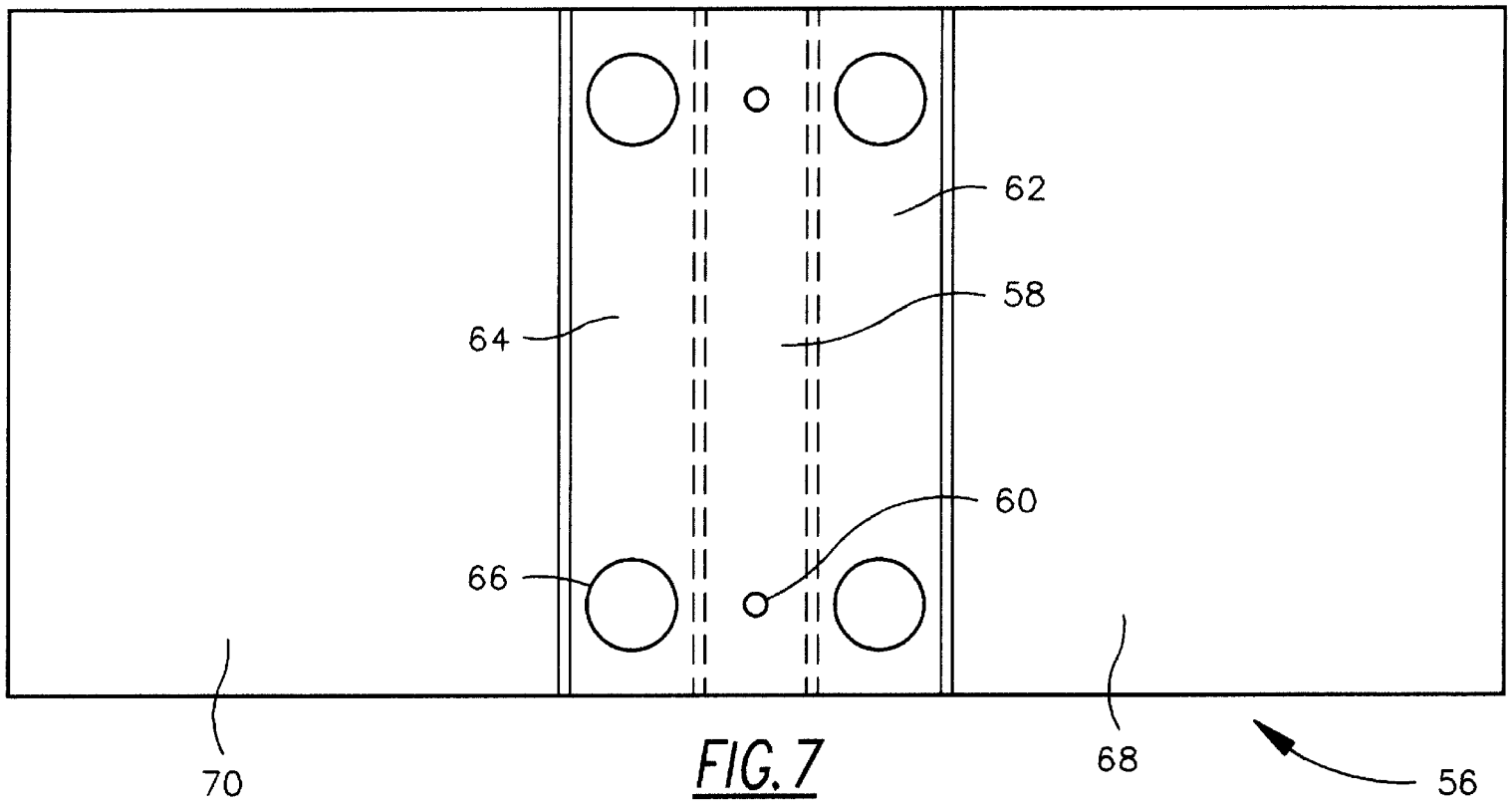
FIG. 7 is a plan view of a flat vane prior to being formed into a vane.
Figure 8:
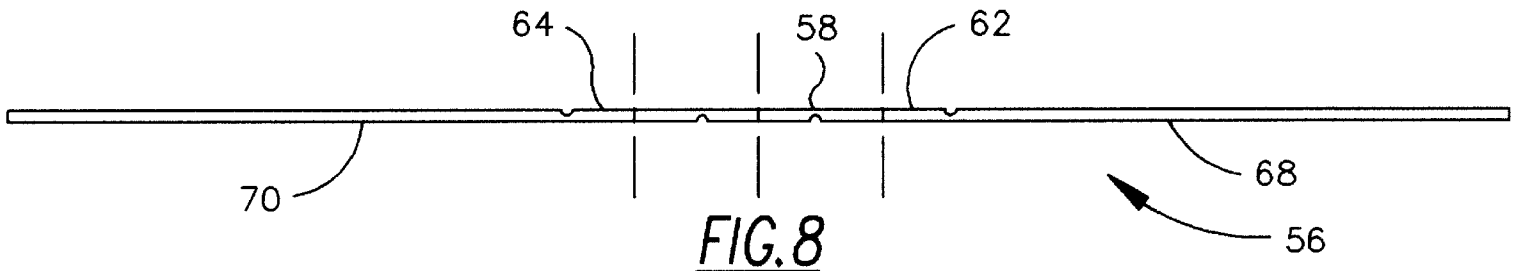
FIG. 8 is a top view of the vane of FIG. 7.
Figure 9:
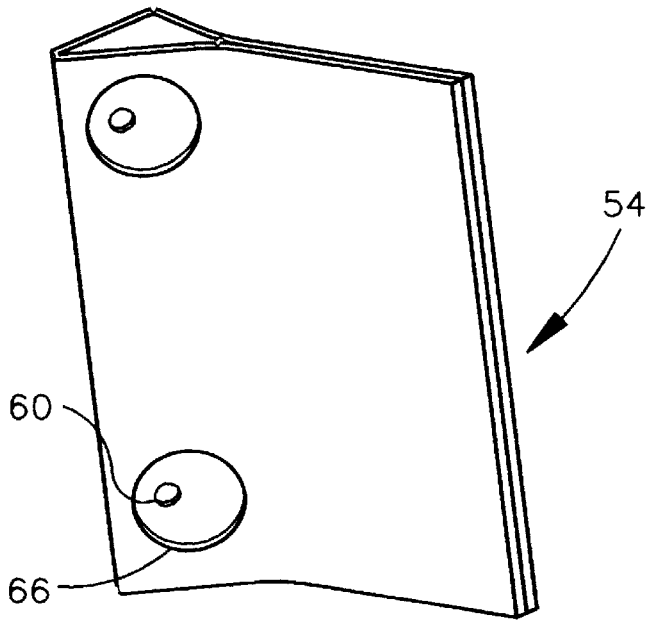
FIG. 9 is a view of the T-shaped vane of FIGS. 7 and 8 after being formed by folding.

A further modified vane 54 is shown in FIGS. 7, 8 and 9. It is comprised of a blank 56 having a back member 58 provided with holes 60, side members 62 and 64 provided with larger holes 66 and elongated leg members 68 and 70. This type of blank is space conserving and can be stacked in quantity and fabricated as needed.

The fabrication is effected by bending and cementing the legs together in a general T-shape. This may be effected by pressure sensitive cement on the legs with peel off protective layers (not shown), or cementing one side, as will be well understood in the art. The vane is affixed to a pedestal or column, or the like, by concrete screws.

Figure 10:
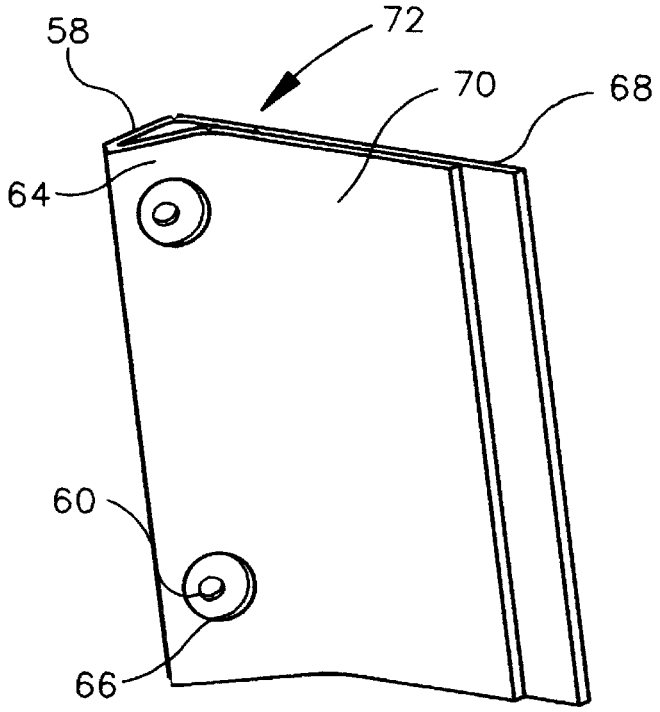
FIG. 10 is the same as FIGS. 7 and 8 except folded into a 90° angle instead of the "T" of FIG. 9.

A still further modified vane 72, similar to vane 54, is shown in FIG. 10. This vane may be fabricated from the blank 56 and is cemented together in the manner shown in FIG. 10 to provide a general L-shape. The legs are cemented together with the ends slightly offset.

The major difference in FIGS. 9 and 10 are the same as FIGS. 6 and 5, respectively, for the T and L-shaped configurations. That is FIGS. 6 and 9 place the attaching fasteners on the centerline of the vane and saw joint. FIGS. 5 and 10 place the attaching fasteners offset from the centerline of the vane and the saw joint.

The centerline or T-shaped mount might be used in many applications, but becomes important in mounting to a round column or curved surface. The act of attachment of the offset or L-shaped mount will rotate the angle around the curved surface and out of the perpendicular position desired. Since the screws, the vane and the saw joint are all in the same vertical plane, the installer only has to establish that one line.

The failure of the centerline mount becomes apparent when attempting to install it at the edge of a pit or rectangular opening (see FIG. 3). In this case the saw joint needs to be in the same plane with the pit wall. This places the screws of the centerline mount half way into the opening. That is, the screws will not hold.

The foldable blank, FIGS. 7 and 8 addresses both situations. It can be folded into an angle with the fasteners offset to the vane in an L-shape or folded into the "T" configuration with the screws on the centerline.

This feature also enabled the blank to be installed flat before folding, making the fasteners easily applied. An added advantage is that by delaying the folding, the flat blank attached to a surface is less likely to be knocked off from other activities such as placing, reinforcing or foot traffic.

The holes 66 provide access to the attachment fasteners, if required, but they also allow concrete to seep in and fill the small triangular annular space created inside the folded vane which ensure a rigid and stable affixation of the vane to the concrete.

Various changes and modifications may be made within this invention as will be apparent to those skilled in the art. Such changes and modifications are within the scope and teaching of this invention as defined in the claims appended hereto.

What is claimed is:

1. A crack control system for a concrete slab abutting a structure, said system comprising: a column or a pedestal; a vane connected to said structure and extending laterally and perpendicularly thereto, a concrete slab abutting said structure; and covering said vane; and a straight line saw cut extending along a top surface of said slab and in straight line alignment with and into said vane for directing stress developed in setting concrete along said saw cut.

2. The crack control system of claim 1 in which said saw cut is filled with a filler material permitting compression upon expansion of boundary concrete.

3. The crack control system of claim 1 in which said vane has a crack directing member of a planiform shape extending vertically and perpendicularly to said structure, said vane having a top edge positioned at the top surface or positioned slightly below the surface of the slab, and a depth approaching the depth of the slab.

4. The crack control system of claim 1 in which the vane is constructed of a material selected from the group consisting of aluminum and plastic.

5. The crack control system of claim 1 in which said vane has a crack directing member of a planiform shape extending vertically and perpendicularly to said structure, said vane having a top edge positioned at or positioned slightly below the surface of the slab and a depth approaching the depth of the slab, and wherein the vane is constructed of a material selected from the group consisting of aluminum and plastic.

6. The crack control system of claim 1 in which the vane is comprised of an angle having a first leg affixed to the structure and a second leg extending perpendicularly thereto, said second leg extending vertically and having a planiform shape extending from a top edge at the surface of the slab or positioned just below the surface of the slab substantially into said slab.

7. The crack control system of claim 1 in which the vane has a vertically extending base provided with a vertically extending keyway receiving to a key means affixed to the structure.

8. The crack control system of claim 7 in which said key means is comprised of a plurality of vertically aligned screws affixed to the structure and said heads are fitted in said keyway.

9. The crack control system of claim 1 in which said vane is comprised of a back member affixed to said structure, opposed side members extending from said member to a crack control member extending perpendicularly from said structure into the concrete slab.

10. The crack control system of claim 9 in which the vane is constructed from a flat plastic blank which can be readily stacked, said blank being comprised of a back member, side members on opposed ends of said back member, and leg members connected to said side members, said blank being foldable to affix said leg members together to form said vane.

11. The crack control system of claim 10 in which at least one of said side members and the back member are affixed with holes receiving concrete screws for affixation of the vane to the structure.

12. The crack control system of claim 10 in which the leg members when connected together have a planiform shape extending vertically and perpendicularly to said structure, said vane having a top at to slightly below the surface of the slab and depth substantially into the slab.

13. The crack control system of claim 1 in which the vane is an angle.

14. The crack control system of claim 13 in which the vane is an angle constructed of a material selected from the group consisting of aluminum and plastic.

* * * * *